US006880866B2

(12) United States Patent
Tomaszewski et al.

(10) Patent No.: US 6,880,866 B2
(45) Date of Patent: Apr. 19, 2005

(54) VEHICLE DOOR LATCH

(75) Inventors: Kris Tomaszewski, Newmarket (CA); Roman Cetnar, Newmarket (CA); Alex Kaczmarczyk, Newmarket (CA)

(73) Assignee: Intier Automotive Closures Inc., Newmarket (CA)

( * ) Notice: Subject to any disclaimer, the term of this patent is extended or adjusted under 35 U.S.C. 154(b) by 154 days.

(21) Appl. No.: 10/203,973

(22) PCT Filed: Feb. 15, 2001

(86) PCT No.: PCT/CA01/00181

§ 371 (c)(1),
(2), (4) Date: Aug. 14, 2002

(87) PCT Pub. No.: WO01/63077

PCT Pub. Date: Aug. 30, 2001

(65) Prior Publication Data

US 2003/0094818 A1 May 22, 2003

Related U.S. Application Data

(60) Provisional application No. 60/185,125, filed on Feb. 25, 2000.

(51) Int. Cl.[7] ..... E05C 3/00

(52) U.S. Cl. ..... 292/216; 292/201; 292/DIG. 62; 292/DIG. 65

(58) Field of Search ..... 292/216, 201, 292/DIG. 62, DIG. 65

(56) References Cited

U.S. PATENT DOCUMENTS

| | | | | |
|---|---|---|---|---|
| 4,679,836 A | | 7/1987 | Pupillo et al. | |
| 5,066,054 A | * | 11/1991 | Ingenhoven | 292/201 |
| 5,074,603 A | * | 12/1991 | Brackmann | 292/216 |
| 5,106,135 A | * | 4/1992 | Menke et al. | 292/216 |
| 5,188,406 A | * | 2/1993 | Sterzenbach et al. | 292/216 |
| 5,427,421 A | * | 6/1995 | Hamaguchi | 292/216 |
| 5,476,294 A | * | 12/1995 | Menke | 292/216 |
| 5,494,322 A | * | 2/1996 | Menke | 292/216 |
| 5,603,539 A | * | 2/1997 | Gruhn et al. | 292/216 |
| 5,634,677 A | * | 6/1997 | Buscher et al. | 292/216 |
| 5,676,003 A | * | 10/1997 | Ursel et al. | 70/472 |
| 5,677,236 A | * | 10/1997 | Saitoh et al. | 438/485 |
| 5,762,384 A | * | 6/1998 | Bartel | 292/216 |
| 5,802,894 A | * | 9/1998 | Jahrsetz et al. | 70/264 |
| 5,853,206 A | * | 12/1998 | Kleefeldt et al. | 292/201 |
| 6,003,910 A | | 12/1999 | Dupont et al. | |
| 6,158,788 A | * | 12/2000 | Ikeda et al. | 292/216 |

FOREIGN PATENT DOCUMENTS

| | | |
|---|---|---|
| DE | 2442797 A1 | 3/1976 |
| DE | 8514605 | 7/1985 |
| DE | 8513658 | 6/1994 |
| EP | 0 589 158 A1 B1 | 7/1993 |

* cited by examiner

*Primary Examiner*—Robert J. Sandy
*Assistant Examiner*—Carlos Lugo
(74) *Attorney, Agent, or Firm*—Clark Hill PLC

(57) ABSTRACT

A vehicle door latch (10) has a release lever (22) is mounted to the housing and operably connected to a pawl (62) by a clutch lever (94) extending therebetween. The clutch lever (94) is moveable between an engaged position operably connecting the release lever (22) to the pawl (62) effecting movement of the pawl toward the released position and a disengaged position operably disconnecting the release lever from the pawl. A locking lever (100) is mounted to the housing for moving the clutch lever (94) between the engaged and disengaged positions. The clutch lever (94) moves in a first plane (19) to effect movement of the pawl and the locking lever moves the clutch lever out the first plane (19) to effect movement between the engaged and said disengaged positions.

25 Claims, 8 Drawing Sheets

VEHICLE DOOR LATCH

This application claims the benefit of provisional application No. 60/185,125 filed Feb. 25, 2000.

FIELD OF THE INVENTION

This invention relates generally to vehicle door latches and more specifically to the actuation and locking mechanisms associated with such latches.

BACKGROUND OF THE INVENTION

Most vehicle door latches currently in production share certain basic operational principals. The operating mechanism is generally mounted to a housing, which in turn is arranged for mounting in the vehicle door. The housing includes a slot for registering with and receiving a wire or rod keeper of a striker mounted to the vehicle adjacent the perimeter of the door. A ratchet is provided to engage and release the striker in respective rest and release positions. The ratchet is held in the rest position by a pawl. The pawl is moveable out of engagement with the ratchet to release the ratchet and in turn allow the striker to be withdrawn from the slot. Movement of the pawl is generally effected by at least one release lever. Often there are separate release levers associated with an inside door handle of the vehicle and an outside door handle of the vehicle.

At least the outside release lever may be connected to the pawl by a locking mechanism which in turn is actuated by a locking mechanism. In such arrangements, the vehicle door lock will engage or disengage the locking mechanism whereby movement of the release lever will not be translated into movement of the pawl.

In current latch arrangements, the ratchet, pawl, locking mechanism and lock actuator lie in parallel planes or orthogonal planes and movement is about generally parallel pivoting axi. The prior art arrangement as described in U.S. Pat. No. 6,102,453, presents some challenges where power operated locking mechanisms are utilized because it may leave little room for placement of the power actuator.

Additionally, the design of the prior art latches prevent the latches from being easily modified to accommodate different applications. Each latch application requires a complete set of tools to manufacture the different latches for each application.

SUMMARY OF THE INVENTION

It is desirable to provide a vehicle door latch in which a lock lever has two degrees of freedom such that movement in a first plane effects latching and unlatching and movement out the first plane effects locking and unlocking of the latch.

It is desirable to provide a vehicle door latch in which the basic latch design can be modified to accommodate different latch applications, including front and rear doors, sliding doors and liftgates.

The disadvantages of the prior art may be overcome by providing a vehicle door latch that has a housing having a mouth for receiving a striker. A ratchet is pivotally mounted to the housing for rotation between latched and unlatched conditions. The ratchet cooperates with the mouth to selectively retain a striker. A pawl is mounted to the housing for releasably engaging the ratchet. The pawl is moveable relative to the ratchet between a rest position engaging the ratchet to block movement of the ratchet toward the unlatched condition and a released position disengaging the ratchet to allow movement of the ratchet toward the unlatched condition. A release lever is mounted to the housing and operably connected to the pawl by a clutch member extending therebetween. The clutch lever is moveable between an engaged position operably connecting the release lever to the pawl effecting movement of the pawl toward the released condition and a disengaged position operably disconnecting the release lever from the pawl. A locking lever is mounted to the housing for moving the clutch lever between the engaged and disengaged positions. The clutch lever moves in a first plane to effect movement of the pawl and the locking lever moves the clutch lever out the first plane to effect movement between the engaged and said disengaged positions.

According to another aspect of the invention, the clutch lever is mountable at a first and second location. When the clutch lever is mounted at the first location, the clutch lever moves in a first plane to effect movement of the pawl and the locking lever moves the clutch lever out the first plane to effect movement between the engaged and the disengaged positions. When the clutch lever is mounted at the second location, the clutch lever moves in a second plane.

DESCRIPTION OF DRAWINGS

In drawings which illustrate embodiments of the present invention.

DESCRIPTION OF PREFERRED EMBODIMENTS

Figure 1:
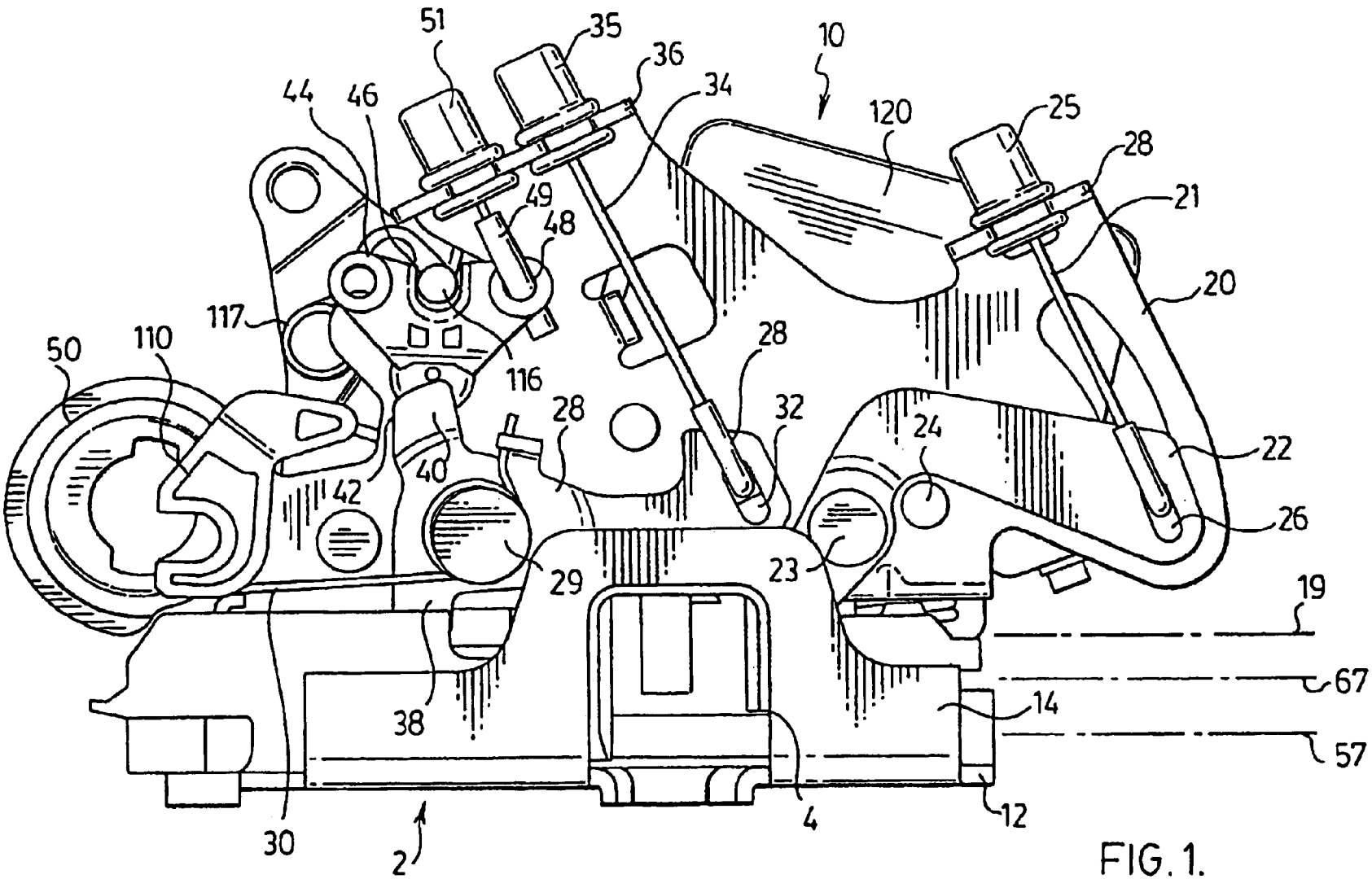
FIG. 1 is a side elevation view of a door latch according to the present invention.
Figure 2:
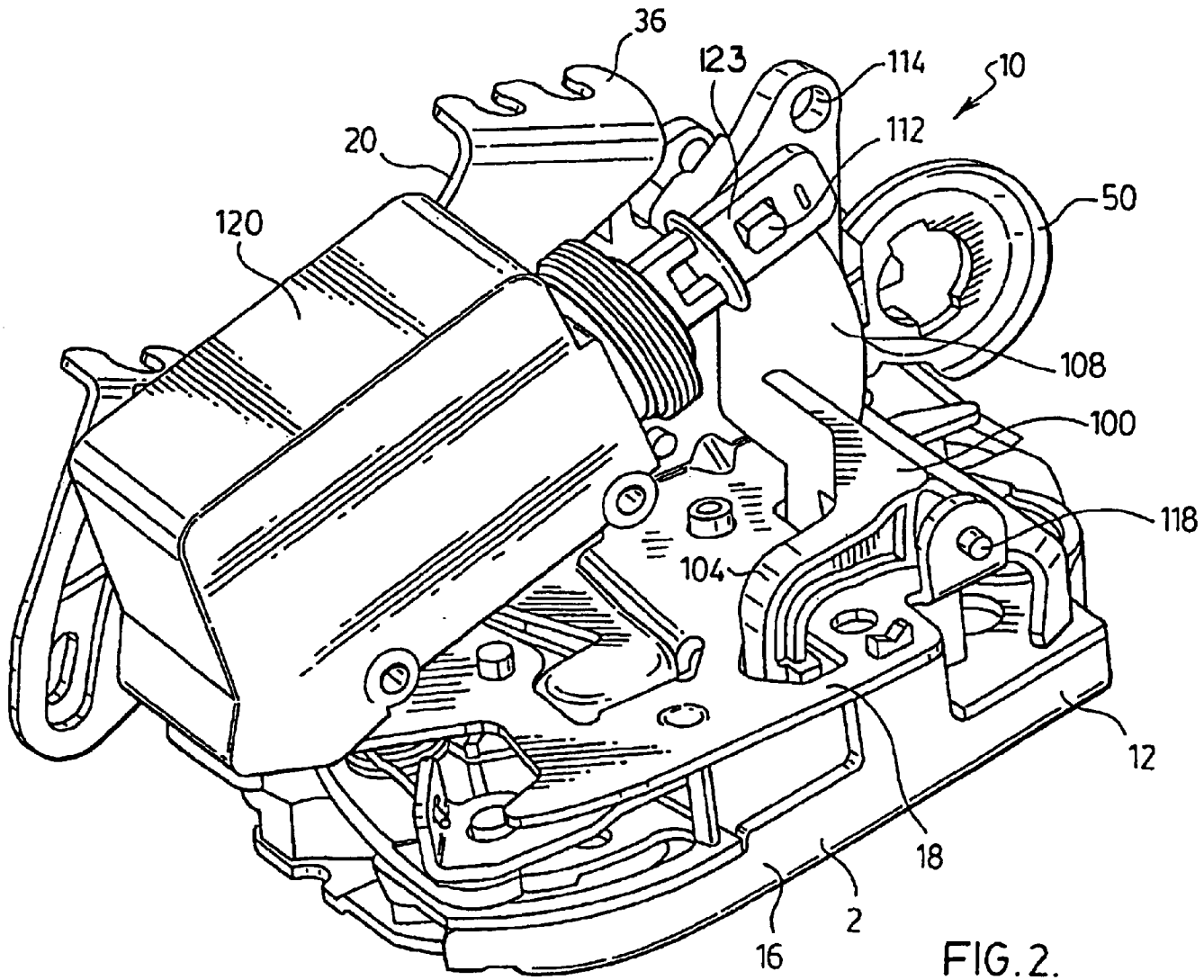
FIG. 2 is a perspective view of the door latch of FIG. 1.
Figure 3:
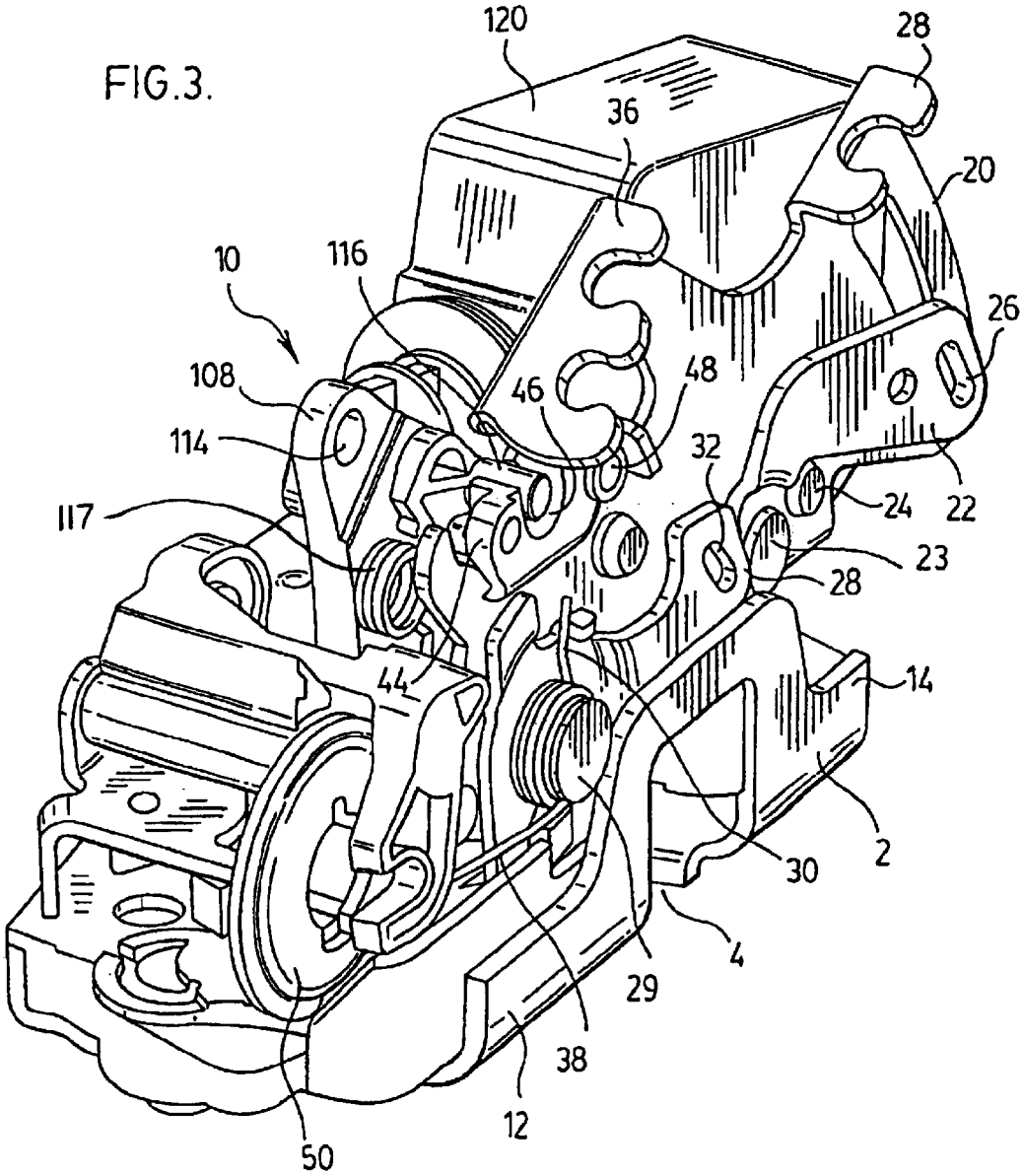
FIG. 3 is a perspective view of the door latch of FIG. 1 taken from a side opposite from FIG. 2.

A latch according to the present invention is generally illustrated by reference 10 in the accompanying drawings. Referring in particular to FIGS. 1 to 3, the latch 10 includes a housing 2 having a mouth 4 for receiving a striker, as is well know in the art. The striker cooperates with the mouth 4 to selectively latch and unlatch.

The housing 2 has a face plate 12 stamped from sheet metal. One side of the face plate 12 has a flange 14 which extends generally perpendicular thereto and surrounds the mouth 4. The opposite side of the face plate 12 has a flange 16 defining a spacer for mounting cover plate 18. Cover plate 18 has a support flange 20 extending generally perpendicular to the face plate 12. Cover plate 18 is stamped from sheet metal and has a series of apertures stamped or formed therein as will be discussed below.

Outside release lever 22 is rotatably mounted on support flange 20 by pin 23. Outside release lever 22 is an L-shaped lever. The "toe" or shorter end extends below the cover plate 18 to a first depth or plane 19. The distal or "leg" end of the lever 22 has an aperture 26 for receiving a Bowden wire 21. The end of the outer casing 25 of the Bowden wire mounts on tab 28 of the support flange 20. A rivet 24 provides an abutment limiting travel of the release lever 22 in a rest condition. Actuation of the Bowden cable will cause longitudinal displacement of the toe of the lever 22 in a first plane 19.

Inside release lever 28 is rotatably mounted on support flange 20 by pin 29. Spring 30 extends between the inside release lever 28 and the support flange 20 to bias the inside release lever 28 to the rest position. The distal end of the inside release lever 28 has an aperture 32 for receiving an end of Bowden wire 34. The outer casing 35 of the Bowden wire 34 mounts on tab 36 of the support flange 20. Inside release lever 28 is T-shaped having a first end 38 extending below the cover plate 18 to the first depth or plane 19. The opposite end 40 has a cam surface 42.

Inside lock lever 44 is rotatably mounted on support flange 20. Inside lock lever 44 is V-shape pivotally connected to the support flange 20 at the apex of the V. The legs of the V define a U-shaped notch 46 and one of the legs has an aperture 48. A Bowden wire 49 connects with the aperture 48 and the outer casing 51 of the Bowden wire connects to the tab 36.

Support flange 20 has a key cylinder mount 50 for receiving a key cylinder, as is well known in the art.

Figure 4:
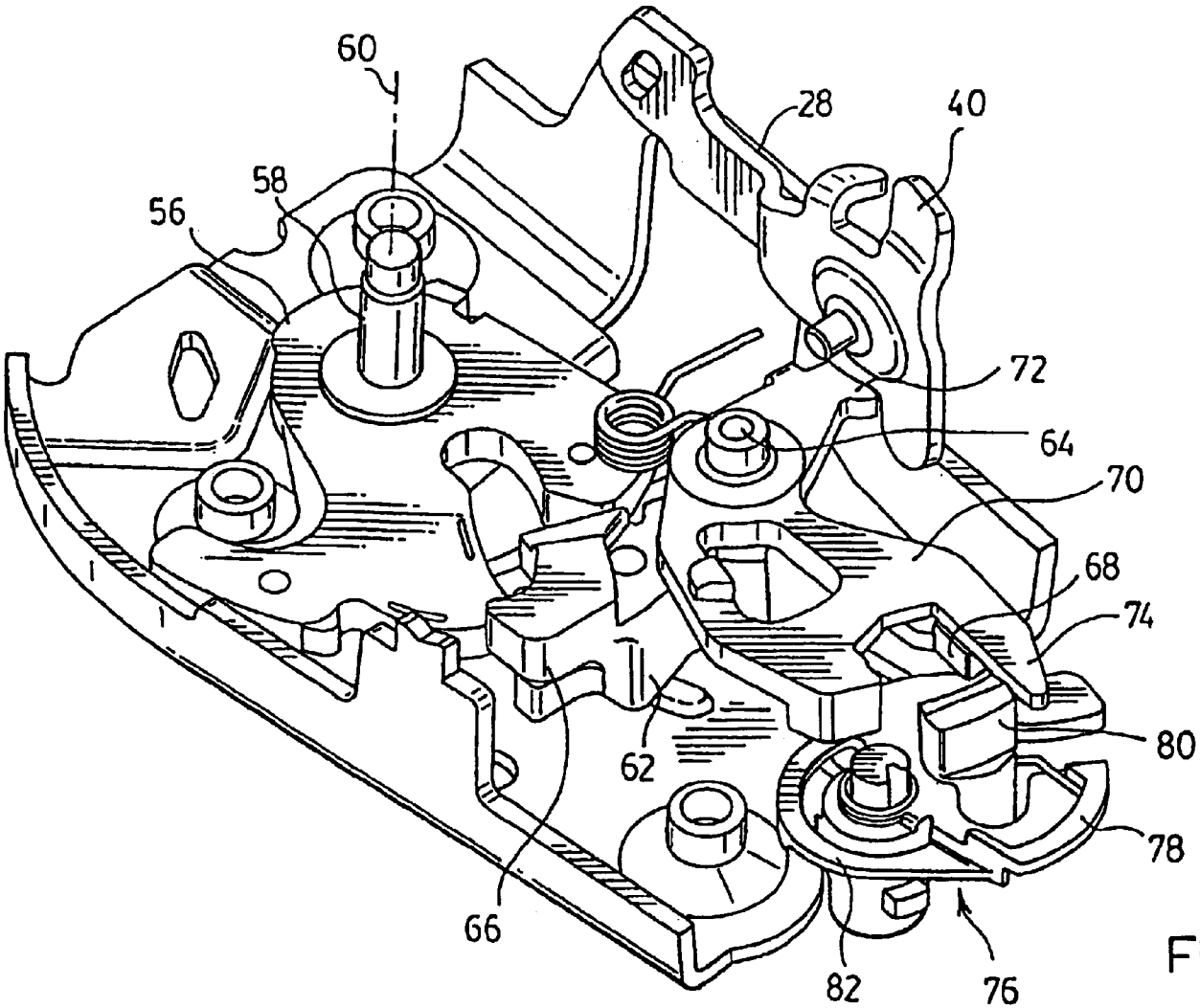
FIG. 4 is a perspective partial cut-away view of a door latch of FIG. 1.

As illustrated in FIG. 4, ratchet 56 is pivotally mounted on a shaft 58 for rotation about a ratchet axis 60. The ratchet is U-shaped and is pivotally movable between a latched and an unlatched condition. In the latched condition, the ratchet 56 cooperates with the mouth 4 for capturing a striker. Ratchet 56 is biased to the unlatched condition. Ratchet 56 has two abutment surfaces corresponding to the fully latched condition and a partially latched confirguration. Ratchet 56 is mounted for rotation on a third plane 57 extending parallel to the first plane 19. The third plane is closest to the face plate 12.

A pawl 62 is mounted to the housing for releasably engaging the ratchet 56 on pin 64. The pawl 62 is movable relative to the ratchet between a rest position where it engages the ratchet 56 to block rotational movement of the ratchet 56 toward the unlatched condition and a release position in which it disengages the ratchet 56 to allow movement thereof toward its unlatched condition. Pawl 62 is biased to engage the ratchet.

Figure 5:
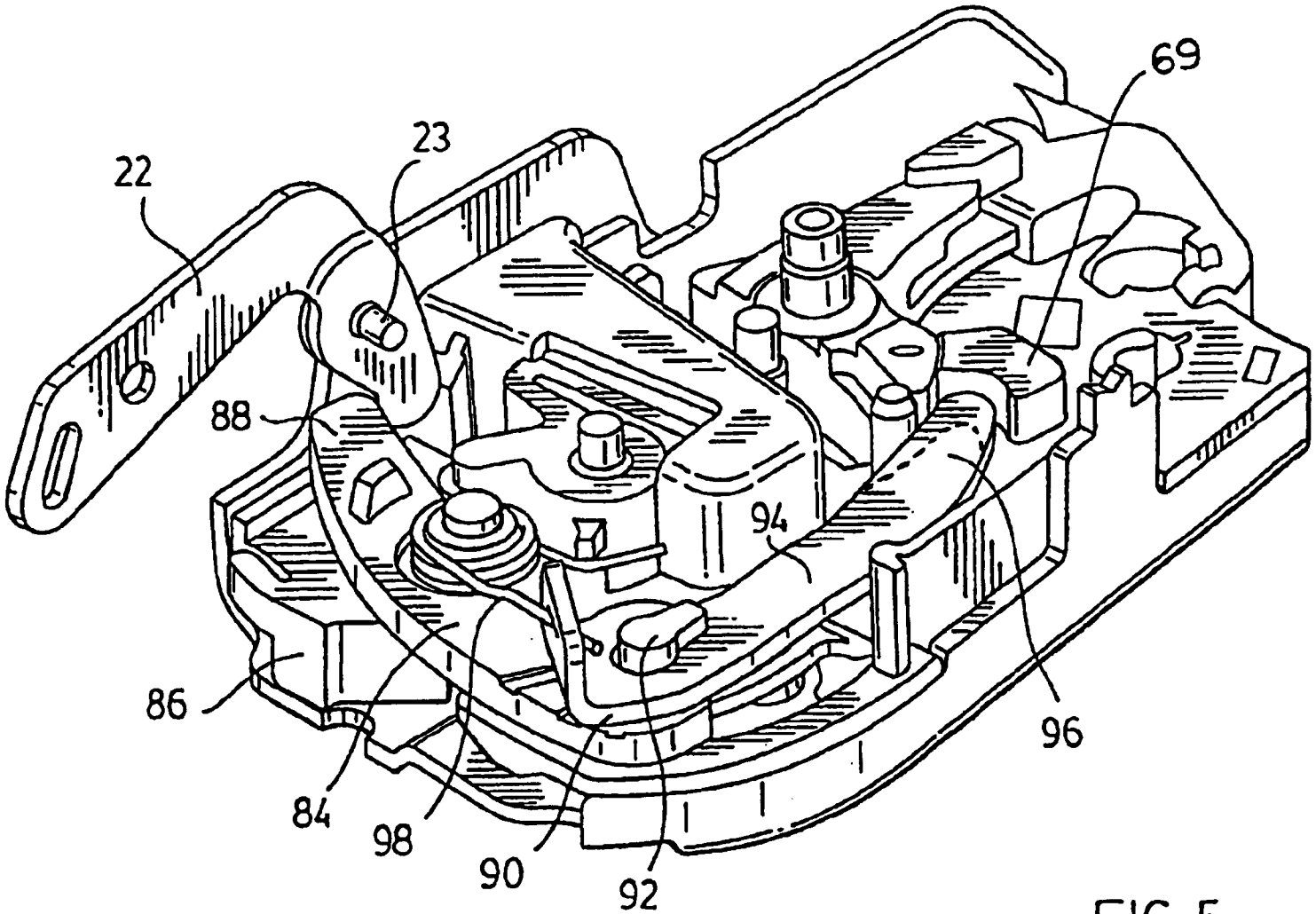
FIG. 5 is a perspective partial cut-away view of a door latch of FIG. 1.

Referring additionally to FIG. 5. pawl 62 has two arms 66 and 68. Arm 68 extends longitudinally of the face plate 12 in a second plane 67 intermediate the first 19 and third planes 57. Arm 66 extends generally laterally in the first, second and third planes, having an arm 69 which extends only in the first plane 19.

As seen in FIG. 4, coaxially mounted on pin 64 is inside connecting lever 70. Lever 70 rotates in the first plane 19. Lever 70 is L-shaped. The toe 72 is positioned to engage the toe of inside release lever 28. Rotation of lever 28 responsively effects rotation of inside connecting lever 70. Lever 70 has a U-shaped "leg" end 74.

Child lock switch 76 is pivotally mounted to the face plate 12. Switch 76 pivots between a child lock condition and an engaged condition. Switch 76 has a flange 78 having a tab 80 that extends between the first and second planes. When the switch 76 is in the child lock condition, tab 80 is rotated to be out of the U-shaped end 74, uncoupling the lever 70 from the pawl arm 68. When the switch 76 is rotated to the engaged condition, tab 80 is positioned in the bight of the U-shaped end 74 to interengage between and couple the lever 70 with the pawl arm 68, enabling the release lever 28 to rotate the pawl 62 and release the ratchet 56.

Optionally, switch 76 is molded with an integral ring spring formation 82 to bias the switch 76 to either the child lock condition or the engaged condition.

Referring to FIG. 5, the outside release arm 22 is illustrated. An outside connecting lever 84 is pivotally mounted to the molded core 86 of the housing. Connecting lever 84 has diametrically opposed arms 88 and 90 and is centrally pivoted. Arm 88 extends in the first plane 94 to engage the release lever 22. Arm 90 extends in the second plane 67. The distal end of the arm 90 has a keyhole shaped pin 92 extending into the first plane 19. Mounted on pin 92 is an elongated clutch arm 94. Clutch arm 94 has a distal end 96 which engages arm 69 of the pawl 62. Clutch arm 94 is constrained by core 86 to reciprocate in a longitudinal direction in the first plane 19. However, clutch arm 94 also pivots or rocks to allow the distal end 96 to move out of the first plane 19 towards the second plane as indicated in stippled lines. Spring 98 extends from the core 86 to the clutch arm 94 to bias the clutch arm 94 to move in the first plane 19. When the clutch arm 94 is constrained to travel in the first plane 19, clutch arm 94 couples the outside release lever 22 with the pawl 62 to effect unlatching. As will be discussed below, when the distal end 96 of clutch arm 94 is pivoted out of the first plane 19, the clutch arm 94 will not engage the arm 67 of the pawl 62, uncoupling or locking the latch 10. When the clutch arm 94 is deflected out of the first plane 19, outside release lever 22 will not effect unlatching of the latch 10.

Optionally, clutch arm 94 may be provided with a slot which receives a pin constraining the movement thereof to the longitudinal and inter-plane movement.

Figure 6:
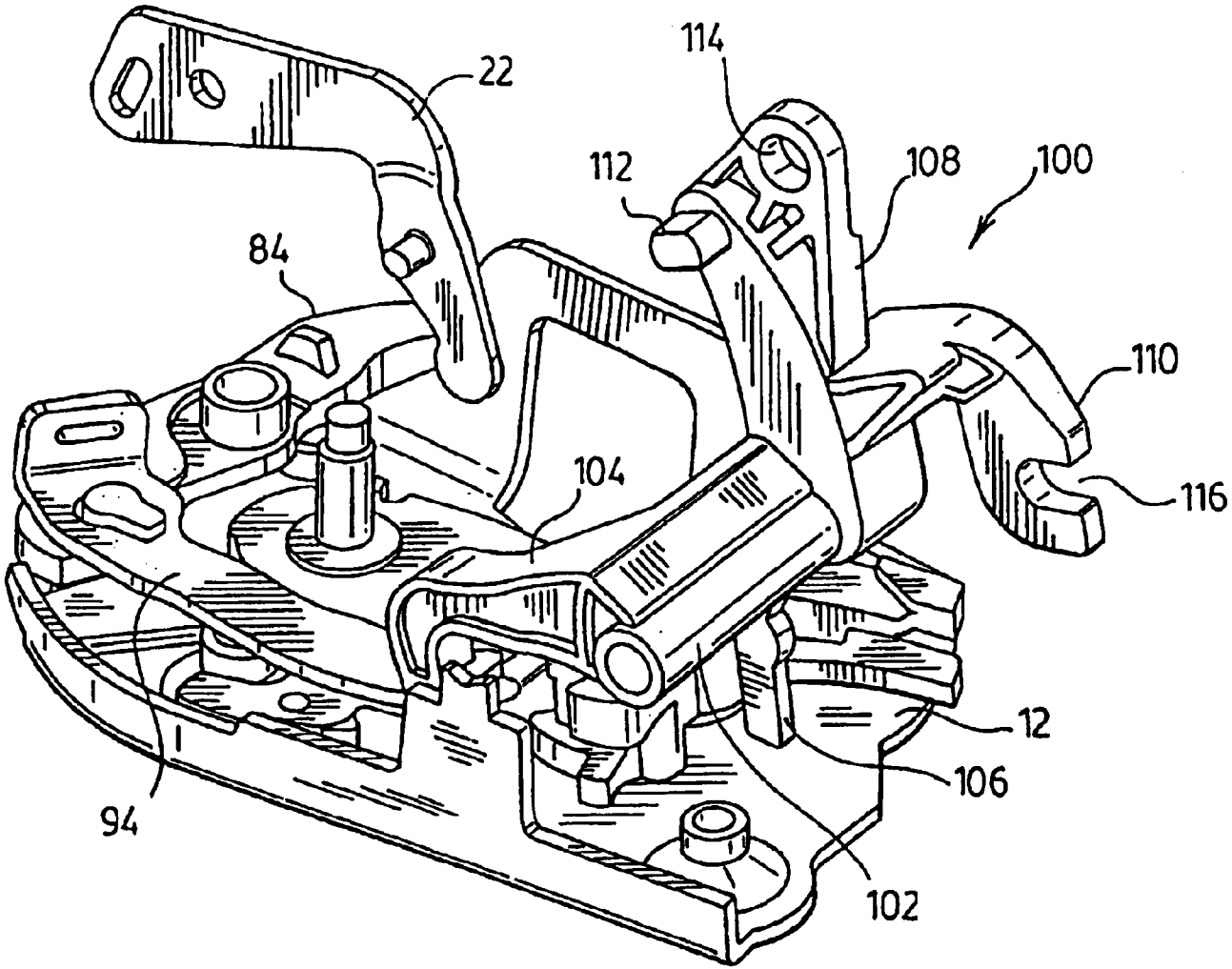
FIG. 6 is a perspective partial cut-away view of a door latch of FIG. 1.

Referring now to FIG. 6, the locking lever 100 is illustrated. Locking lever 100 has a hollow body 102 having arms 104, 106, 108 and 110 extending therefrom. Arm 104 is J-shaped and positioned at one end of the body 102. The toe of the J-shape has an unlocked positioned at the first plane 19 and an locked position extending towards second plane 67. Arm 104 is aligned to engage clutch arm 94. Thus, movement of the arm 104 effects movement of the clutch arm 94 to deflect the distal end of the clutch arm 94 out of the first plane 19.

Arm 106 extends towards the face plate 12 at approximately the mid-point of the hollow body 102.

Arm 108 extends away from the first plane 19 at approximately 90° relative to arm 104. Arm 108 has tab 112 extending generally axially with hollow body 102. Arm 108 is also provided with an aperture 114 at the distal end. On a face opposite tab 112 is pin 116. Pin 116 is positioned to engage with inside lock lever 44 (FIG. 3) and fitted within U-shaped notch 46. Spring 117 is fitted between the support flange 20 and the arm 108. Spring 117 biases locking lever 100 to either the locked or unlocked positions. Movement effected by Bowden cable 49 will effect a pivoting movement of the inside locking lever 44, which will responsively effect movement of the locking lever 100 between the locked and unlocked positions.

Arm 110 is hook shaped and is connected to arm 108 offset from the axis of rotation of the hollow body 102. The distal end of arm 110 has a U-shaped notch 116. The U-shaped notch is positioned to generally align with the key cylinder mount 50.

Referring back to FIG. 2, locking lever 100 is pivotally mounted on the cover plate 18 on shaft 118 to define an axis of rotation generally parallel to the first plane 19. Locking lever 100 is able to pivot between an unlocked position and a locked position. In the locked position, arm 104 will extend through cover plate 18 to deflect clutch arm 94 out of first plane 19, disabling or uncoupling the outside release lever 22.

An actuator 120 is mounted on support flange 20. The output shaft 123 is connected to tab 112 of the locking lever 100. Actuator 120 is energized to move between an extended position and a retracted position. In the extended position, output shaft 123 will rotate locking lever 100 to the unlocked position. In the retracted position, output shaft 123 will rotate locking lever to the unlocked position.

Referring back to FIG. 1, inside release lever 28 is rotatable between a rest position and a release position. As the inside release lever 28 is rotated from the rest position to the release, tab 40 will engage the base of arm 110, if the locking lever 100 is in the locked position. Further rotation of the inside release lever 28, the base of arm 110 will travel along cam surface 42 to the locking lever 100 to rotate from the locked condition to the unlocked condition. Additionally, rotation of the inside release lever 28 will effect release of the latch 10, if the child lock feature 76 is engaged.

Figure 8:
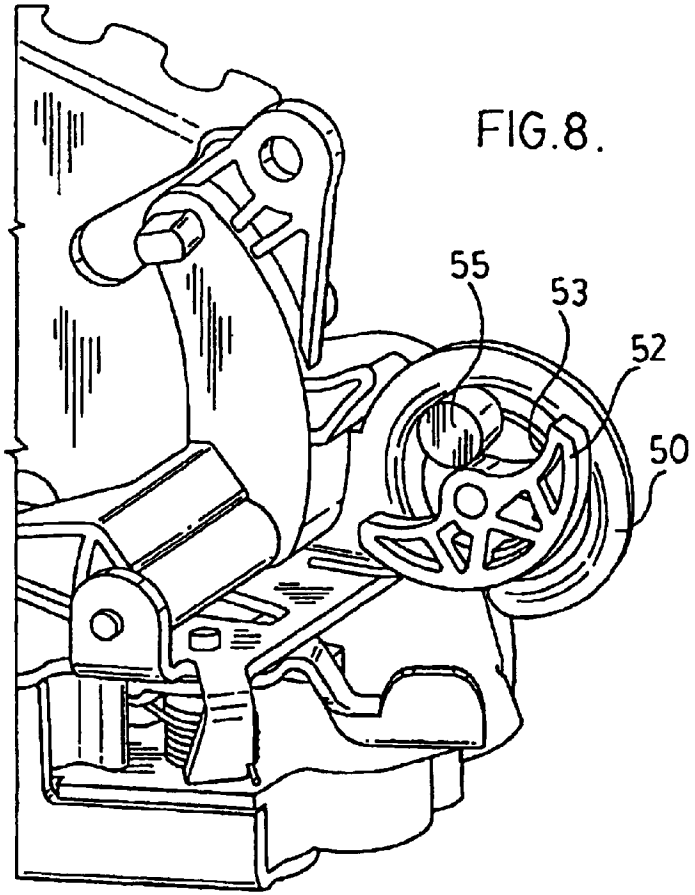
FIG. 8 is a partial perspective view of a door latch of FIG. 7.
Figure 7:
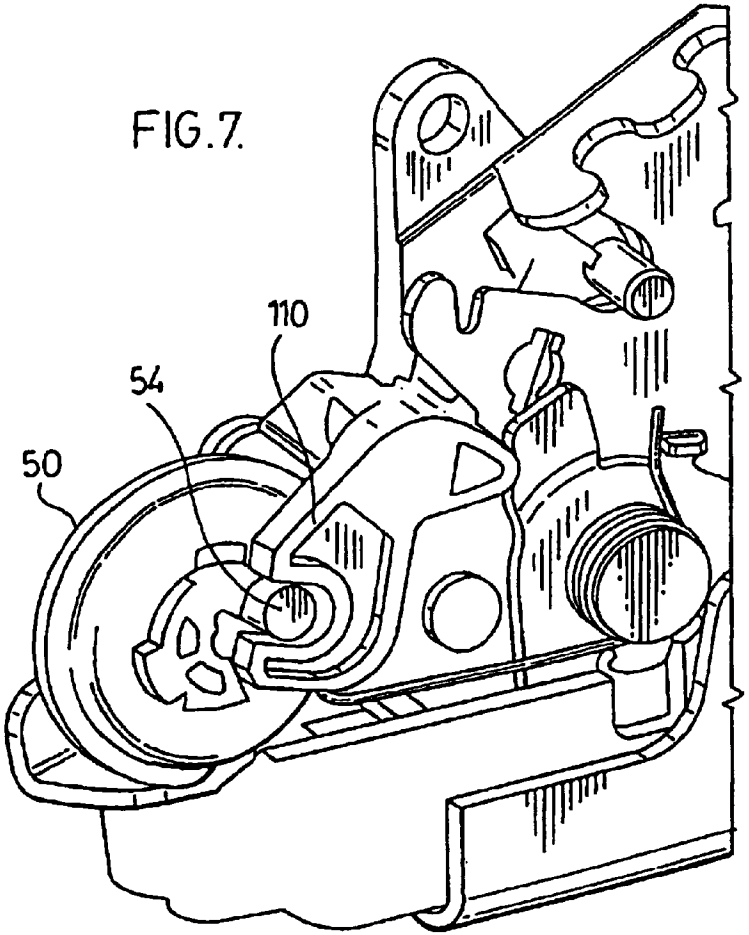
FIG. 7 is a partial perspective view of a door latch of FIG. 1 with a key arrangement.

Referring now to FIGS. 7 and 8, the key locking feature is illustrated. A conventional key cylinder (not illustrated) is mounted to the key cylinder mount 50. A disc 52 is rotatably mounted in an aperture of the mount 50. A pin 54 extends from the disc 52 to engage with arm 110. A double crescent cam surface 53 is provided to cooperate with a key cylinder interface 55. Rotation of the key cylinder interface 55 in a first sense will effect rotation of arm 110 from the locked condition to the unlocked condition and rotation in an opposite sense will effect rotation from the unlocked to the locked condition. The cam surface 53 of the disc 52 provides an amount of free or lost motion of the disc 52 relative to the interface 55. This arrangement enables the arm 110 to move in response to the releasing movement of the inside locking lever 28 without responsively moving the key interface 55.

Figure 9:
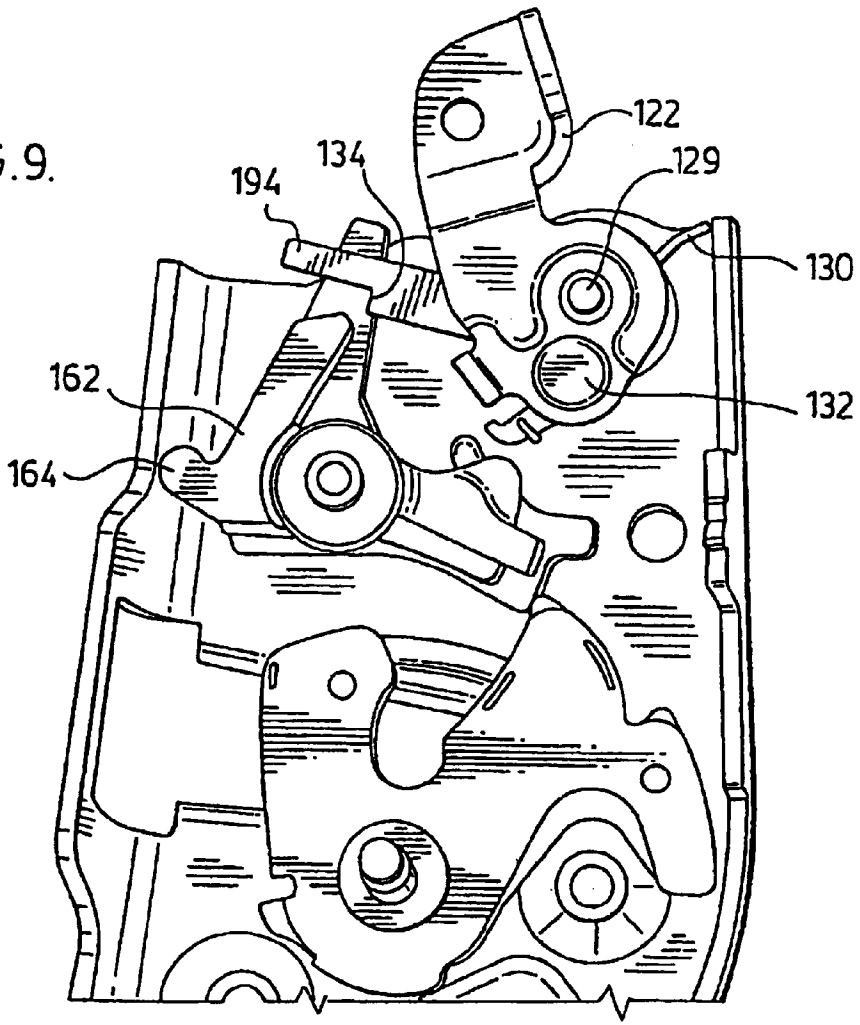
FIG. 9 is a top plan view of latch according to the present invention with an alternative outside release lever location.

Referring now to FIG. 9, an alternate location for mounting the outside release lever is illustrated. The outside release lever 122 is pivotally mounted on the face plate 12 at pin 129. Spring 130 extends between release lever 122 and clutch arm 194 to bias both into a rest position. Clutch arm 194 is pivotally mounted outside release lever 122 at pin 132. Clutch arm 194 has an abutment 134 which will engage pawl 162 to effect releasing of the latch 10. Rotation of locking lever 100 between the locked condition and the unlocked condition moves arm 106. Arm 106 will effect movement of clutch arm 194. When in the locked condition, arm 106 will deflect the clutch arm 194 so that the arm 194 does not contact the pawl 162. When in an unlocked condition, the arm 106 will not deflect clutch arm 194, enabling engagement of the arm 194 with the pawl 162 to effect unlatching.

Additionally, pawl 162 has a tab 164 which can engage directly with inside release lever 28 and replace the child lock switch 76.

It is now apparent to those skilled in the art that the vehicle latch of the present invention is easily modified for use in the different applications, namely, front and rear doors, sliding doors, liftgates, and can have numerous features incorporated therein or not. The latch of the present invention can be incorporated with many features, including a key cylinder, a child lock feature, and automatic unlocking on activating the inside release lever. The variations can be manufactured using common components thereby reducing part count and the tooling required to manufacture the components.

[check ref. 116]

The above description is intended in an illustrative rather than a restrictive sense. Variations from the exact description may be apparent to those skilled in such devices without departing from the scope of the invention as defined by the claims set out below.

What is claimed is:

1. A vehicle door latch comprising:

a housing having a mouth for receiving a striker;

a ratchet pivotally mounted to said housing for rotation between a latched and unlatched conditions, said ratchet cooperating with said mouth for selectively retaining a striker;

a pawl mounted to said housing for releasably engaging said ratchet, said pawl being moveable relative to said ratchet between a rest position engaging said ratchet to block movement of said ratchet toward said unlatched condition and a released position disengaging said ratchet to allow movement of said ratchet toward said unlatched condition;

a release lever mounted to said housing, said release lever being operably connectable to said pawl by a clutch member extending therebetween, said clutch lever being moveable between an engaged position operably connecting said release lever to said pawl effecting movement of said pawl toward said released condition and a disengaged position operably disconnecting said release lever from said pawl; and, a locking lever mounted to said housing for moving said clutch lever between said engaged and said disengaged positions;

wherein said clutch lever moves in a first plane to effect movement of the pawl and said locking lever moves a portion of said clutch lever out the first plane to effect movement between said engaged and said disengaged positions.

2. A latch as claimed in claim 1, wherein said clutch lever is constrained for reciprocating movement in the first plane.

3. A latch as claimed in claim 2, wherein said release lever is an outside release lever.

4. A latch as claimed in claim 3, wherein said latch further includes an inside release lever pivotally mounted to said housing, said inside release lever operably connected to said pawl for effecting movement thereof.

5. A latch as claimed in claim 4, wherein said latch further includes an inside release lever pivotally mounted to said housing, said inside release lever selectively engaging a child lock switch, said child lock switch moveably mounted to said housing to move a tab between an engaged position and a disengaged position, said tab coupling said inside release lever to said pawl when said child lock switch is in the engaged position and uncoupling the inside release lever from the pawl when said child lock switch is in the disengaged position.

6. A latch as claimed in claim 4, wherein said inside release lever engages said locking lever to move the locking lever from the locked position to the unlocked position as the inside release lever is moved from the rest position to the release position.

7. A latch as claimed in claim 4, wherein said locking lever is operably connected to a key cylinder, said locking lever responsively moves between the locked position and unlocked position is response to locking and unlocking movement of the key cylinder.

8. A latch as claimed in claim 4, wherein said latch further includes an actuator mounted on said housing, said actuator operably connected to said locking lever to move the locking lever responsively between the locked position and unlocked position.

9. A latch as claimed in claim 4, wherein said latch further includes an inside locking leer pivotally mounted to said housing and operably connected to said locking lever to move the locking lever responsively between the locked position and unlocked position.

10. A latch as claimed in claim 9, wherein said housing has a support flange extending orthogonally from said first plane and said actuator and inside release lever are mounted thereon.

11. A latch as claimed in claim 9, wherein said locking lever is mounted on an external surface of said housing and said locking lever has an arm extending into said housing to effect said movement of said clutch lever between said engaged and said disengaged positions.

12. A latch as claimed in claim 11, wherein said clutch lever is biased to move in said first plane and said locking lever overcomes said bias in effecting said movement of said clutch lever from said engaged position to said disengaged position.

13. A vehicle door latch comprising:

a housing having a mouth for receiving a striker;

a ratchet pivotally mounted to said housing for rotation between a latched and unlatched conditions, said ratchet cooperating with said mouth for selectively retaining a striker;

a pawl mounted to said housing for releasably engaging said ratchet, said pawl being moveable relative to said ratchet between a rest position engaging said ratchet to block movement of said ratchet toward said unlatched condition and a released position disengaging said ratchet to allow movement of said ratchet toward said unlatched condition;

a release lever mounted to said housing and operably connectable to said pawl by a clutch lever extending therebetween, said clutch lever being moveable between an engaged position operably connecting said release lever to said pawl effecting movement of said pawl toward said released condition and a disengaged position operably disconnecting said release lever from said pawl; and, a locking lever mounted to said housing for moving said clutch lever between said engaged and said disengaged positions;

wherein said clutch lever moves in a first plane to effect movement of the pawl and said locking lever moves said clutch lever out the first plane to effect movement between said engaged and said disengaged positions; and wherein each of said release lever and said clutch lever is mountable to said housing at one of two locations, and when said clutch lever is mounted at a first location, said clutch lever moves in and out of said first plane, and when said clutch lever is mounted at the a second location, said clutch lever moves in a second plane.

14. A latch as claimed in claim 13 wherein said locking lever has a first arm positioned for engagement with the clutch lever when mounted at the first location and a second arm positioned for engagement with the clutch lever when mounted at the second location.

15. A latch as claimed in claim 14, wherein said release lever is an outside release lever.

16. A latch as claimed in claim 15, wherein said latch further includes an inside release lever pivotally mounted to said housing, said inside release lever operably connected to said pawl for effecting movement thereof.

17. A latch as claimed in claim 15, wherein said latch further includes an inside release lever pivotally mounted to said housing, said inside release lever selectively engaging a child lock switch, said child lock switch moveably mounted to said housing to move a tab between an engaged position and a disengaged position, said tab coupling said inside release lever to said pawl when said child lock switch is in the engaged position and uncoupling the inside release lever from the pawl when said child lock switch is in the disengaged position.

18. A latch as claimed in claim 16 wherein said inside release lever engages said locking lever to move the locking lever from the locked position to the unlocked position as the inside release lever is moved from the rest position to the release position.

19. A latch as claimed in claim 16, wherein said locking lever is operably connected to a key cylinder, said locking lever responsively moves between the locked position and unlocked position is response to locking and unlocking movement of the key cylinder.

20. A latch as claimed claim 16, wherein said latch further includes an actuator mounted on said housing, said actuator operably connected to said locking lever to move the locking lever responsively between the locked position and unlocked position.

21. A latch as claimed in claim 16, wherein said latch further includes an inside locking lever pivotally mounted to said housing and operably connected to said locking lever to move the locking lever responsively between the locked position and unlocked position.

22. A latch as claimed in claim 21, wherein said housing has a support flange extending orthogonally from said first plane and said actuator and inside release lever are mounted thereon.

23. A latch as claimed in claim 21, wherein said locking lever is mounted on an external surface of said housing and said first and second arms extend into said housing to effect said movement of said clutch lever between said engaged and said disengaged positions.

24. A latch as claimed in claim 21 wherein said clutch lever is biased to move in said first plane and said locking lever overcomes said bias in effecting said movement of said clutch lever from said engaged position to said disengaged position.

25. A vehicle door latch comprising:

a housing having a mouth for receiving a striker;

a ratchet pivotally mounted to said housing for rotation between a latched and unlatched conditions, said ratchet cooperating with said mouth for selectively retaining a striker;

a pawl mounted to said housing for releasably engaging said ratchet, said pawl being moveable relative to said ratchet between a rest position engaging said ratchet to block movement of said ratchet toward said unlatched condition and a released position disengaging said ratchet to allow movement of said ratchet toward said unlatched condition;

a release lever mounted to said housing, said release lever being operably connectable to said pawl by a clutch arm extending therebetween, said clutch arm being moveable between an engaged position operably connecting said release lever to said pawl effecting movement of said pawl toward said released condition and a disengaged position operably disconnecting said release lever from said pawl; and, a locking lever mounted to said housing for moving said clutch arm between said engaged and said disengaged positions;

said clutch arm being pivotably connected at a proximal end to said release lever by a connecting lever which is pivotably mounted to said housing for movement parallel to a first plane;

said clutch arm has a distal end opposite said proximal end and adjacent said pawl;

said distal end of said clutch arm is moved out of said first plane into said disengaged position; and a biasing means is mounted to act between said proximal end of said clutch arm and said housing to urge said clutch arm towards said engaged position, to urge said clutch arm away from said pawl, and to urge said linking arm and in turn said release lever toward a non released configuration.

* * * * *